US005995785A

United States Patent [19]

Kato et al.

[11] Patent Number: 5,995,785

[45] Date of Patent: Nov. 30, 1999

[54] IMAGE FORMING APPARATUS HAVING A MECHANISM FOR PREVENTING STRIPPING OFF OF A LUBRICANT FROM A CLEANING BLADE

[75] Inventors: Junichi Kato; Tadashi Onimura, both of Toride; Koichi Suwa, Ushiku; Satoru Inami, Kashiwa; Jun Suzuki, Numazu; Atsutoshi Ando, Kashiwa, all of Japan

[73] Assignee: Canon Kabushiki Kaisha, Tokyo, Japan

[21] Appl. No.: 08/953,977

[22] Filed: Oct. 20, 1997

[30] Foreign Application Priority Data

Oct. 21, 1996 [JP] Japan ..... 8-278361

[51] Int. Cl.[6] ..... G03G 21/00

[52] U.S. Cl. ..... 399/127; 399/71; 399/350

[58] Field of Search ..... 399/127–129, 399/71, 350

[56] References Cited

U.S. PATENT DOCUMENTS

| | | | |
|---|---|---|---|
| 4,278,342 | 7/1981 | Andrew et al. | 399/169 |
| 4,396,276 | 8/1983 | Murasaki | 399/13 |
| 4,945,389 | 7/1990 | Usui et al. | 399/71 |
| 4,956,677 | 9/1990 | Akiyama | 399/129 |
| 5,140,375 | 8/1992 | Shindo et al. | 399/45 |
| 5,145,724 | 9/1992 | Yanai et al. | 427/430.1 |
| 5,175,584 | 12/1992 | Usui | 399/44 |
| 5,862,432 | 1/1999 | Nakayama et al. | 399/71 X |

FOREIGN PATENT DOCUMENTS 59-147373 8/1984 Japan .

*Primary Examiner*—Matthew S. Smith
*Attorney, Agent, or Firm*—Fitzpatrick, Cella, Harper & Scinto

[57] ABSTRACT

An image forming apparatus includes, an image bearing member, a charger which may be a main charger and auxiliary charger for charging the image bearing member, a developing unit for forming a toner image by developing an electrostatic latent image formed on the image bearing member using a toner having the same polarity as that of the charger, a transfer electrode, having a width different from that of the charger and contacting a transfer material, for applying a bias voltage having a polarity opposite to that of the charger to the transfer material, the cleaning blade contacting the image bearing member in a counter direction relative to a moving direction of the image bearing member in order to scrape and remove toner particles remaining on the image bearing member after the image transfer due to the potential of the image bearing member, and a member for reducing a charging potential difference between the charger and the transfer electrode generated on the image bearing member. A lubricant may be applied between the image bearing member and the cleaning blade member. By making the width of the charger and the width of the transfer electrode substantially the same, the charging potential difference between the charger and the transfer electrode generated on the image bearing member is reduced.

17 Claims, 8 Drawing Sheets

IMAGE FORMING APPARATUS HAVING A MECHANISM FOR PREVENTING STRIPPING OFF OF A LUBRICANT FROM A CLEANING BLADE

BACKGROUND OF THE INVENTION

1. Field of the Invention

The present invention relates to an image forming apparatus which utilizes an electrophotographic process, such as an electrophotographic copier, an electrophotographic printer or the like.

2. Description of the Related Art

A conventional image forming appartus is configured, for example, as shown in FIG. 6. That is, a cylindrical electrophotographic photosensitive member (hereinafter termed a "photosensitive drum") 1, serving as an image bearing member, is provided within a main body 8 of the image forming apparatus, and rotates in the direction shown by arrow R1 around its shaft. The surface of the photosensitive drum 1 is uniformly charged by a charging roller 2, serving as a charging member, and then an electrostatic latent image is formed by an exposure device 3. A developing device 4 includes a hopper 4*b* for storing a toner 4*a*, and a developing roller 4*c*, serving as a developer carrying member. The developing roller 4*c* forms a visual image by supplying the electrostatic latent image formed on the photosensitive drum 1 with the toner 4*a* while regulating the toner 4*a* carried on the developing roller 4*c* by a developing blade 4*d*, serving as a developer regulating member, contacting the developing roller 4*c*.

The toner image on the photosensitive drum 1 visualized by the toner 4*a* in the developing device 4 in the above-described manner is transferred onto a transfer material 9 by a transfer roller 5, serving as a transfer member. The transfer material 9 is fed from a sheet feeding cassette 11 by a sheet feeding roller 10, and is sent to the transfer roller 5 while being synchronized with the toner image on the photosensitive drum 1 by registration rollers (not shown). The transfer material 9 having the toner image transferred thereto is then conveyed to a fixing device 6 so that the toner image is fixed by heat or pressure to form a recorded image. On the other hand, particles of the toner 4*a* remaining on the photosensitive drum 1 which have not been transferred by the transfer roller 5 are removed by an elastic cleaning blade 7*a* of a cleaning device 7 and are stored in a waste-toner receptacle 7*b*. Then, the surface of the photosensitive drum 1 is again charged by the charging device 2, and another image formation operation may be performed by repeating the above-described process.

Next, the configuration of the cleaning device 7 will be described in more detail with reference to FIG. 7.

In FIG. 7, the cleaning blade 7*a* comprises, for example, a chip-like rubber member $7a_1$ supported on a supporting plate $7a_2$, and removes toner particles remaining on the photosensitive drum 1 while being pressed against the photosensitive drum 1, which rotates in the direction shown by an arrow R1, with a predetermined pressure. A member 7*c* for preventing leakage of toner particles (hereinafter termed a "scraping sheet") is provided in contact with the photosensitive drum 1 at a portion upstream from the cleaning blade 7*a* in the direction of the rotation of the photosensitive drum 1, in order to prevent removed toner particles from dropping downward.

In the cleaning device 7 having the above-described configuration, when small-size collected substances, such as scraped powder by the cleaning blade 7*a*, toner particles and the like, are present at a portion where the edge portion of the cleaning blade 7*a* contacts the surface of the photosensitive drum 1, the effect of lubrication for the photosensitive layer of the photosensitive drum 1 by the collected substances is not experienced. Hence, the frictional force tends to be highest when starting use of the cleaning device 7. As a result, there arise the problems that, for example, the rotation torque increases, noise is generated, and the cleaning blade 7*a* is, in some cases, bent toward the downstream side in the direction of the rotation of the photosensitive drum 1. Conventionally, in order to prevent such a problem, a powder lubricant 7*d* is coated in advance on an edge portion of the cleaning blade 7*a* to reduce the frictional force when starting use of the cleaning device 7.

However, in the above-described conventional image forming apparatus, in general, as shown in FIG. 8, the contact region of the charging roller 2 (a region between A and A') is formed in the longitudinal direction of the photosensitive drum 1, the contact region of the transfer roller 5 (a region between B and B') is formed within the contact region of the charging roller 2, and the contact region of the cleaning blade 7*a* is formed so as to cover the entire region including the contact region of the charging roller 2.

By thus regulating the lengths of the charging roller 2, the transfer roller 5 and the cleaning blade 7*a* with respect to the photosensitive drum 1, the surface potential of the photosensitive drum 1 at the contact position of the cleaning blade 7*a* is distributed as shown in FIG. 8. That is, the region between A and A' where the charging roller 2 contacts the photosensitive drum 1 is uniformly charged to a negative potential by the charging roller 2, and a positive bias voltage is applied to the region between B and B' where the transfer roller 5 contacts the photosensitive drum 1.

Thus, in the distribution of the surface potential of the photosensitive drum 1 at the contact position of the cleaning blade 7*a*, regions between A and B and between B' and A' assume a negative potential because these regions are negatively charged by the charging roller 2 but are not positively charged by the transfer roller 5. On the other hand, the region between B and B' assumes a potential of substantially 0 V because this region is negatively charged by the charging roller 2 and also is positively charged by the transfer roller 5.

The surface potential of the photosensitive drum 1 at the contact position of the cleaning blade 7*a* also is substantially 0 V, although somewhat more so than the potential in the region between B and B'.

That is, in the regions between A and B and between B' and A', an electric field is generated between the cleaning blade 7*a* and the surface of the photosensitive drum 1. By the Coulomb force due to the electric field, the lubricant 7*d* on the cleaning blade 7*a* is peeled and moves toward the photosensitive drum 1. Accordingly, the frictional force with respect to the surface of the photosensitive drum 1 increases at portions of the cleaning blade 7*a* where the lubricant 7*d* is stripped off, and the cleaning blade 7*a* is bent at these portions.

SUMMARY OF THE INVENTION

It is an object of the present invention to solve the above-described problems.

It is another object of the present invention to provide an image forming apparatus in which a lubricant is not stripped off from a cleaning blade, and bending of the cleaning blade is prevented.

According to one aspect, the present invention which achieves these objetives relates to an image forming apparatus, including an image bearing member, charging means for charging the image bearing member, developing means for forming a toner image by developing an electrostatic latent image formed on the image bearing member using a toner having the same polarity as that of the charging means, transfer means, having a width different from that of the charging means, for applying a bias voltage having a polarity opposite to that of the charging means to a transfer material in order to electrostatically transfer the toner image formed on the image bearing member onto the transfer material, a cleaning blade member contacting the image bearing member in a counter direction relative to a moving direction of the image bearing member in order to rub and remove toner particles remaining on the image bearing member after the image transfer, a lubricant may be provided between the image bearing member and the cleaning blade member, and means for reducing a charging potential difference between the charging means and the transfer means generated on the image bearing member.

According to another aspect, the present invention which achieves these objetives relates to an image forming apparatus including an image bearing member, charging means for charging the image bearing member, developing means for forming a toner image by developing an electrostatic latent image formed on the image bearing member using a toner having the same polarity as that of the charging means, transfer means, having substantially the same width as that of the charging means, for applying a bias voltage having a polarity opposite to that of the charging means to a transfer material in order to electrostatically transfer the toner image formed on the image bearing member onto the transfer material, a cleaning blade member contacting the image bearing member in a counter direction relative to a moving direction of the image bearing member in order to rub and remove toner particles remaining on the image bearing member after the image transfer, a lubricant may be provided between the image bearing member and the cleaning blade member. A charging potential difference between the charging means and the transfer means generated on the image bearing member is reduced.

According to still another aspect, the present invention which achieves these objetives relates to an image forming device, including an image bearing member, charging means for charging the image bearing member while contacting it, developing means for forming a toner image by developing an electrostatic latent image formed on the image bearing member using a toner having the same polarity as that of the charging means, transfer means, having a width different from that of the charging means and contacting a tranfer material, for applying a bias voltage having a polarity opposite to that of the charging means to the transfer material in order to electrostatically transfer the toner image formed on the image bearing member onto the transfer material, a cleaning blade member contacting the image bearing member in a counter direction relative to a moving direction of the image bearing member in order to rub and remove toner particles remaining on the image bearing member after the image transfer, a lubricant may be provided between the image bearing member and the cleaning blade member, and means for reducing a charging potential difference between the charging means and the transfer means generated on the image bearing member.

According to still another aspect, the present invention which achieves these objetives relates to an image forming apparatus, including an image bearing member, charging means for charging the image bearing member while contacting it, developing means for forming a toner image by developing an electrostatic latent image formed on the image bearing member using a toner having the same polarity as that of the charging means, transfer means, having subtantially the same width as that of the charging means and contacting the tranfer material, for applying a bias voltage having a polarity opposite to that of the charging means to a transfer material in order to electrostatically transfer the toner image formed on the image bearing member onto the transfer material, a cleaning blade member contacting the image bearing member in a counter direction relative to a moving direction of the image bearing member in order to rub and remove toner particles remaining on the image bearing member after the image transfer, and a lubricant may be provided between the image bearing member and the cleaning blade member. A charging potential difference between the charging means and the transfer means generated on the image bearing member is reduced.

According to still another aspect, the present invention which achieves these objetives relates to an image forming apparatus, including a photosensitive member, a charger for charging the photosensitive member while contacting it, a developing unit for forming a toner image by developing an electrostatic latent image formed on the photosensitive member using a toner having the same polarity as that of the charger, a transfer electrode, having a width different from that of the charger and contacting a tranfer material, for applying a bias voltage having a polarity opposite to that of the charger to the transfer material in order to electrostatically transfer the toner image formed on the photosensitive member onto the transfer material, a cleaning blade member contacting the image bearing member in a counter direction relative to a moving direction of the image bearing member in order to rub and remove toner particles remaining on the image bearing member after the image transfer, a lubricant may be provided between the photosensitive member and the cleaning blade member, and means for reducing a charging potential difference between the charger and the transfer electrode generated on the photosensitive member.

According to still another aspect, the present invention which achieves these objetives relates to an image forming apparatus including a photosensitive member, a charger for charging the photosensitive member while contacting it, a developing unit for forming a toner image by developing an electrostatic latent image formed on the photosensitive member using a toner having the same polarity as that of the charger, a transfer electrode, having subtantially the same width as that of the charger and contacting a tranfer material, for applying a bias voltage having a polarity opposite to that of the charger to the transfer material in order to electrostatically transfer the toner image formed on the photosensitive member onto the transfer material, a cleaning blade member contacting the photosensitive member in a counter direction relative to a moving direction of the photosensitive member in order to rub and remove toner particles remaining on the photosensitive member after the image transfer, and a lubricant may be provided between the photosensitive member and the cleaning blade member. A charging potential difference between the charging means and the transfer means generated on the image bearing member is reduced.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described in detail with reference to the drawings.

First Embodiment

Figure 1:
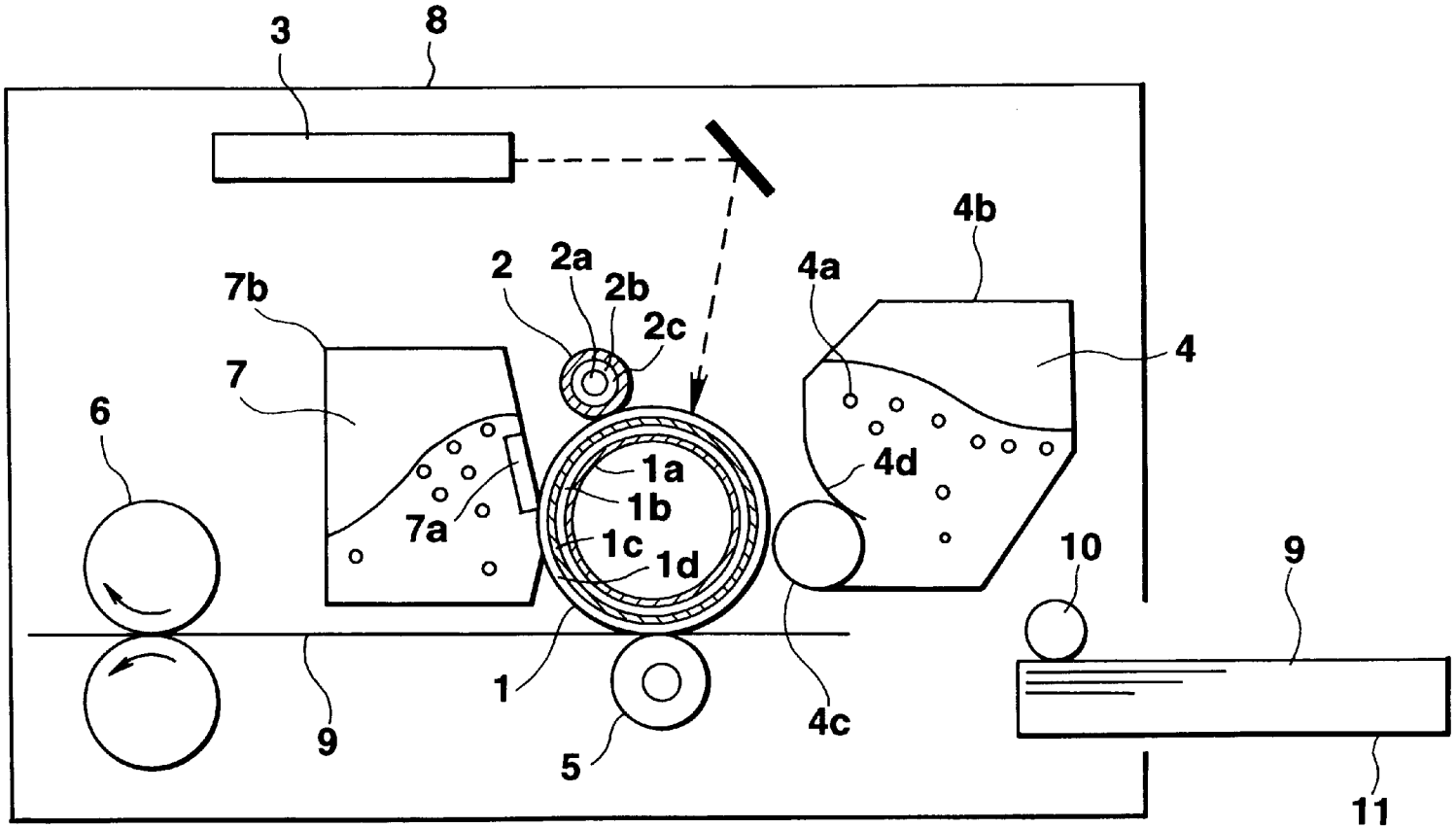
FIG. 1 is a schematic diagram illustrating the configuration of an image forming apparatus according to a first embodiment of the present invention.
Figure 2:
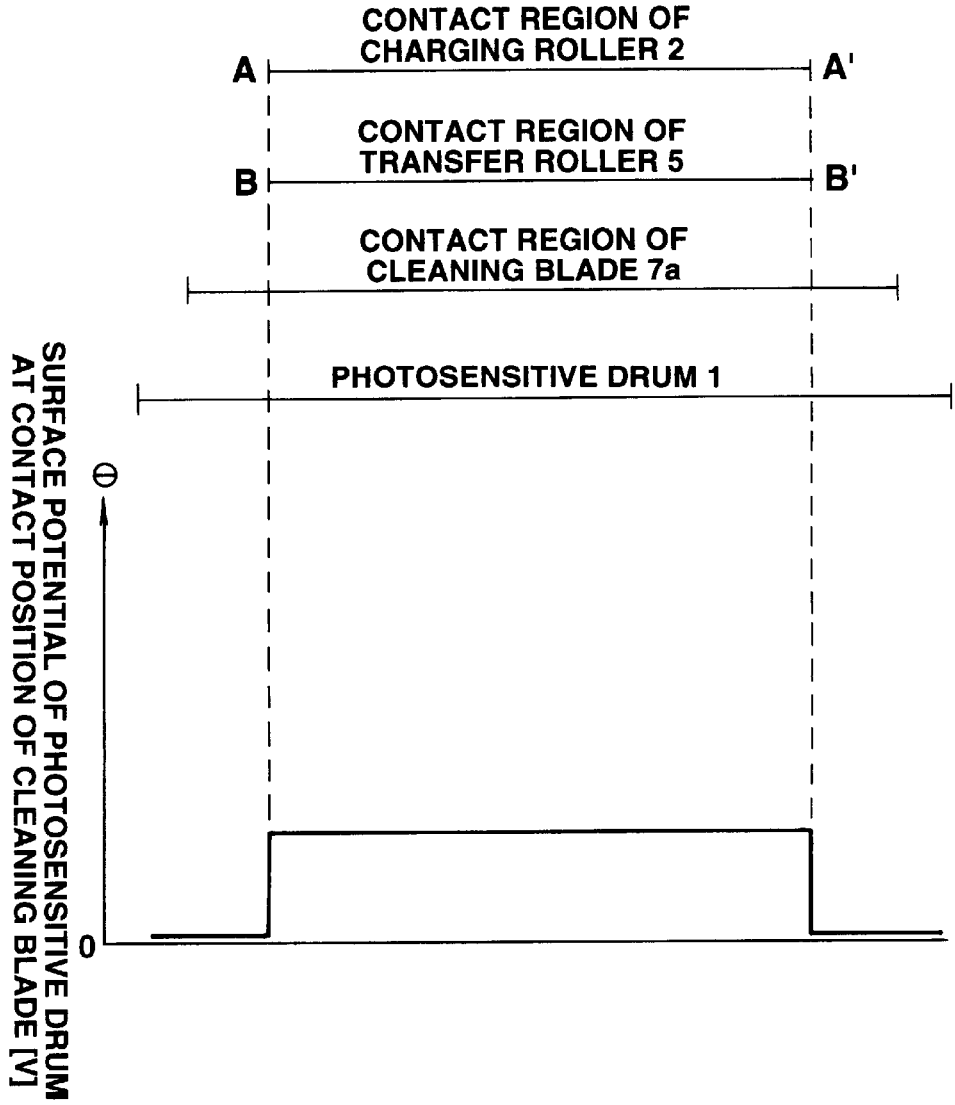
FIG. 2 is a diagram illustrating the surface potential of a photosensitive drum at contact regions of a charging roller, a transfer roller, and a cleaning blade in the first embodiment.
Figure 6:
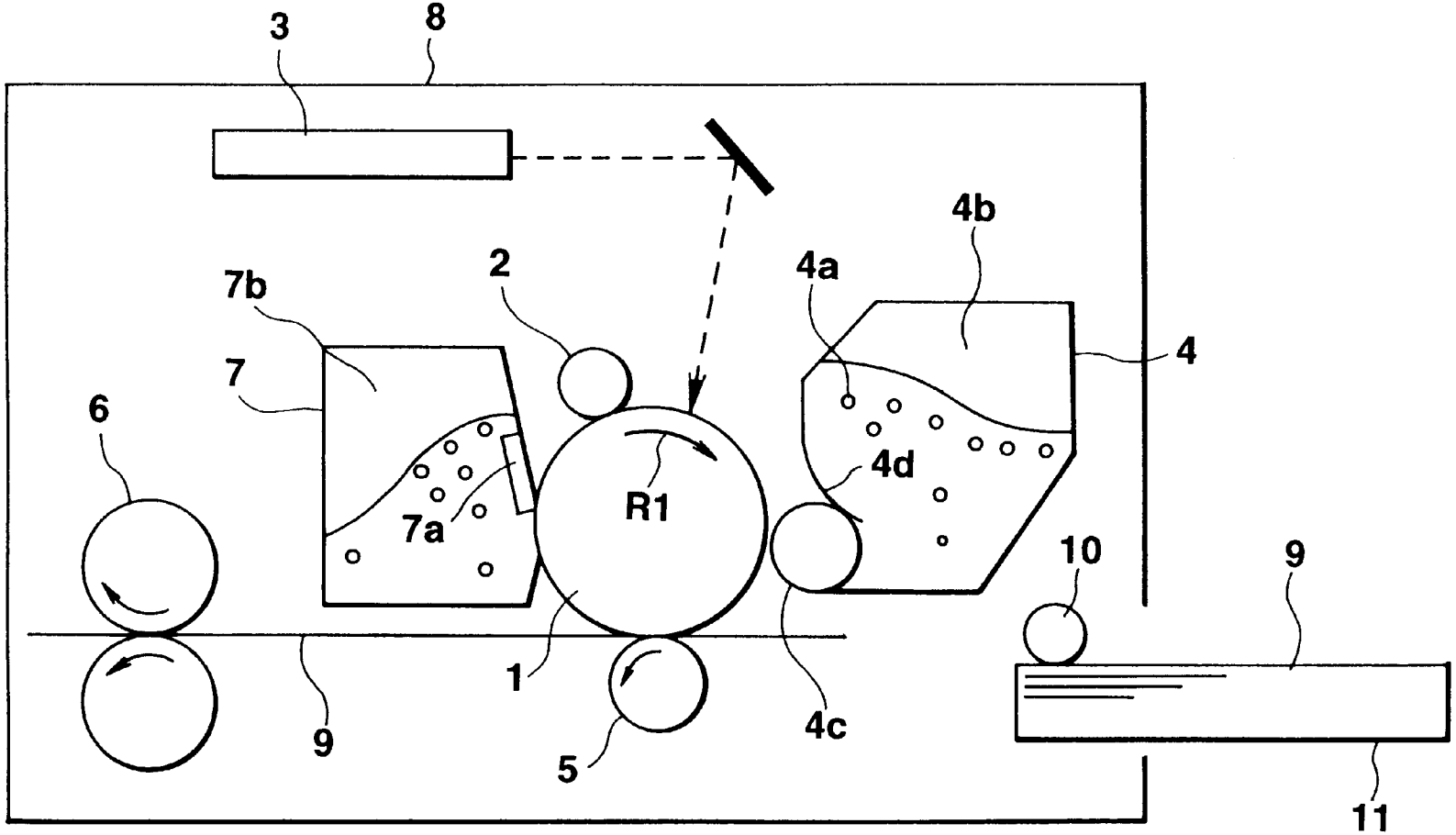
FIG.6 PRIOR ART
FIG. 6 is a schematic diagram illustrating the configuration of a conventional image forming apparatus.
Figure 7:
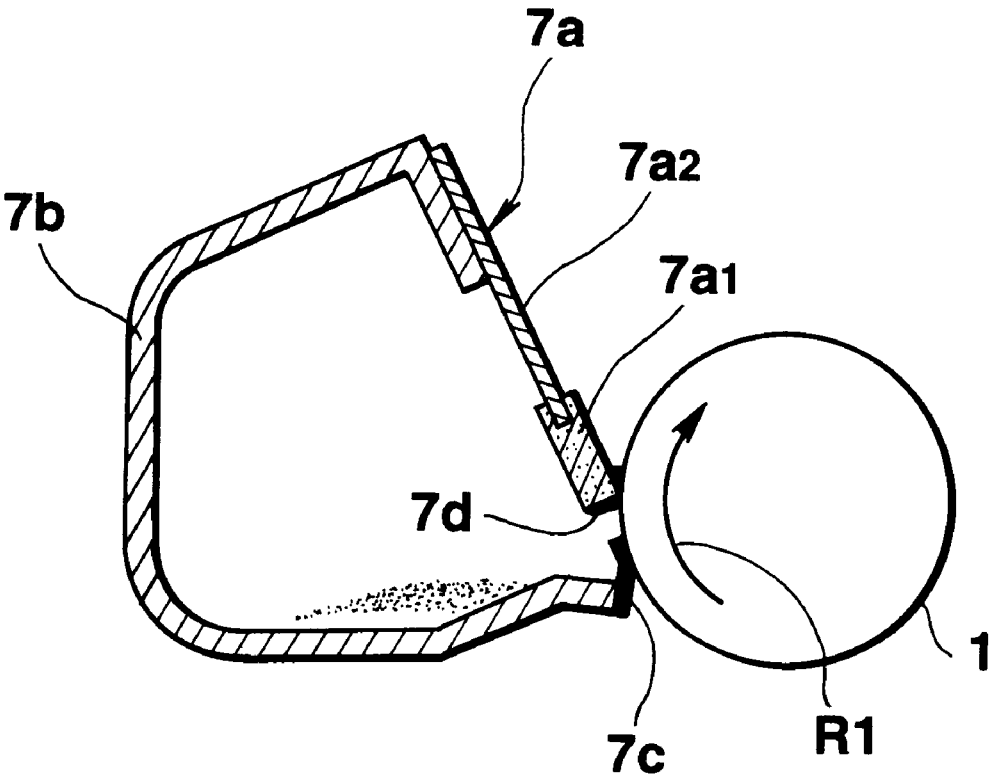
FIG.7 PRIOR ART
FIG. 7 is an enlarged cross-sectional view of a cleaning device shown in FIG. 6.
Figure 8:
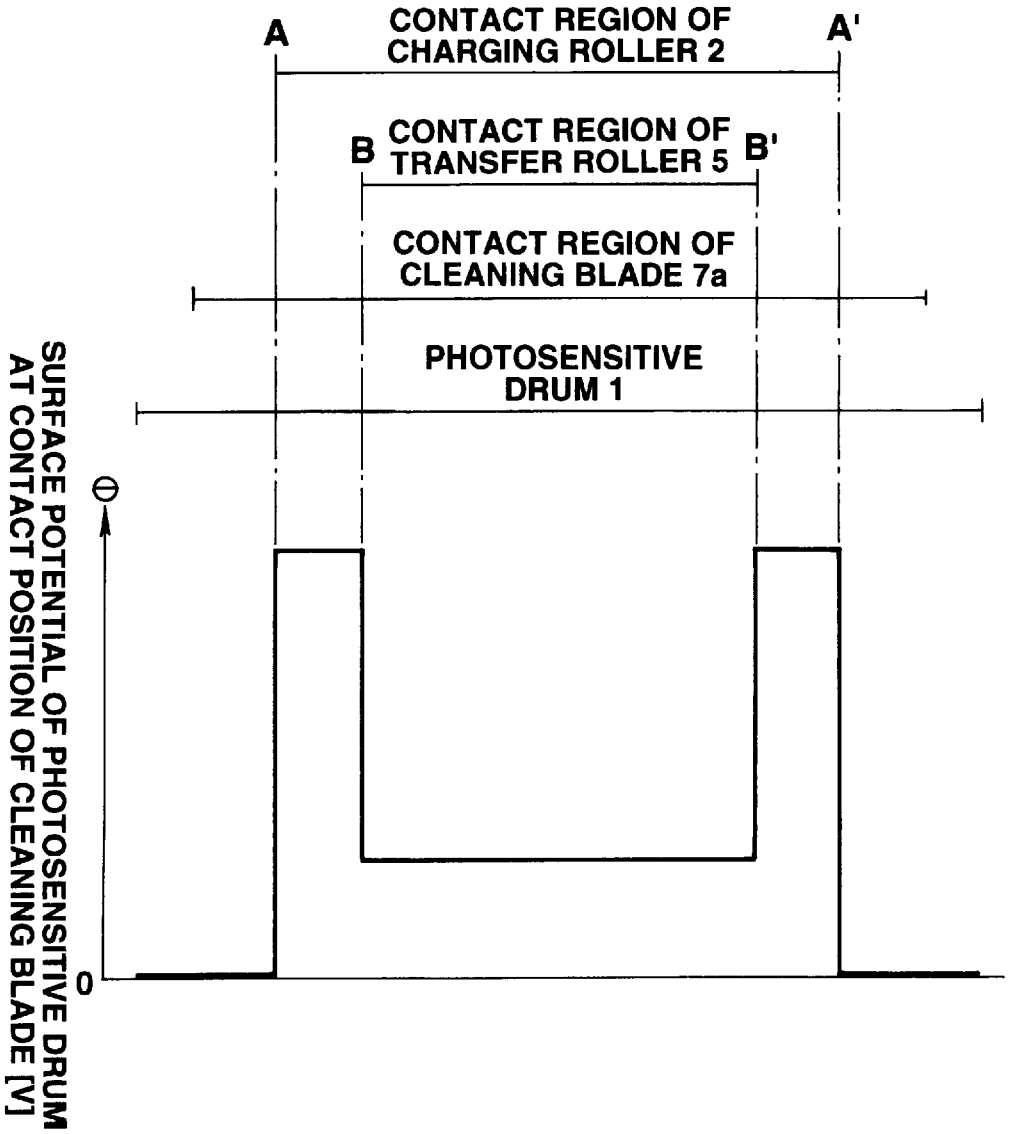
FIG.8 PRIOR ART
FIG. 8 is a diagram illustrating the surface potential of a conventional photosensitive drum at contact regions of a charging roller, a transfer roller and a cleaning blade.

FIG. 1 is a schematic diagram illustrating the configuration of an image forming apparatus according to a first embodiment of the present invention. FIG. 2 is a diagram illustrating the surface potential of a photosensitive drum at contact regions of a charging roller, a transfer roller, and a cleaning blade. In FIG. 1, the same components as those shown in FIG. 6 are indicated by the same reference characters, and a further description thereof will be omitted.

The first preferred embodiment of the invention has a feature in that the contact region of a charging roller 2 (a region between A and A') is substantially the same as the contact region of a transfer roller 5 (a region between B and B') in the longitudinal direction of a photosensitive drum 1. The contact region of a cleaning blade 7*a* in the longitudinal direction of the photosensitive drum 1 is arranged so as to cover at least the region including the contact region of the charging roller 2.

According to this configuration, the surface potential of the photosensitive drum 1 at the contact position of the cleaning blade 7*a* is distributed as shown in FIG. 2. That is, the region beteen A and A' where the charging roller 2 contacts the photosensitive drum 1 is uniformly charged to a negative potential by the charging roller 2, and a positive bias voltage is applied by the transfer roller 5 to the region between B and B' where the transfer roller 5 contacts the photosensitive drum 1. In the first embodiment, the region between A and A' and the region between B and B' have substantially the same length in order to provide a uniform potential. In this region, since the photosensitive drum 1 is negatively charged by the charging roller 2 and is positively charged by the transfer roller 5, the surface potential in the longitudinal direction assumes substantially 0 V uniformly. On the other hand, the surface potential of the contact position of the cleaning blade 7*a*, also is substantially 0 V, although somewhat more so than the potential in the region between B and B'.

As described above, since potential unifying means for preventing the generation of a large electric field between the cleaning blade 7*a* and the surface of the photosensitive drum 1 is provided, a lubricant 7*d* on the cleaning blade 7*a* is not stripped off, and therefore the frictional force with the surface of the photosensitive drum 1 is not increased. Accordingly, bending of the cleaning blade 7*a* can be prevented.

The specific configuration of the first embodiment will now be described.

In the first embodiment, an aluminum cylinder having a diameter of 30 mm and a length of 260 mm was used as a drum base 1*a*. The drum base 1*a* was immersed in a solution obtained by dissolving 4 parts of copolymerized nylon and 4 parts of type-8 nylon in 50 parts of methanol and 50 parts of n-heptanol to form an underlayer 1*b* 0.6 $\mu$m thick thereon.

Then, 10 parts of a copper phthalocyanine pigment and 10 parts of a polyvinyl butyral resin were dispersed in 120 parts of cyclohexanone for 10 hours using a sandmilling apparatus, and 30 parts of methyl ethyl ketone was added to the dispersed solution. The resultant solution was coated on the underlayer 1*b* to form a charge generating layer (CGL) 1*c* 0.15 $\mu$m thick.

Then, a solution obtained by dissolving 10 parts of a polycarbonate resin having a weight-average molecular weight of 120,000 and 10 parts of a hydrazone compound in 80 parts of monochlorobenzene was subjected to spray coating on the CGL 1*c* to form a charge transfer layer (CTL) 1*d* 16 $\mu$m thick.

The charging roller 2 contacting the photosensitive drum 1 includes a stainless-steel core 2*a*, a conductive rubber 2*b* formed thereon, and a leakage prevention layer 2*c* having a volume resistivity of about $10^{10}$ Ωcm formed on the outer circumference of the conductive rubber 2*b*. The volume resistivity of the conductive rubber 2*b* is adjusted by dispersing conductive powder comprising conductive carbon, tin oxide or the like in a synthesized rubber, such as chloroplane rubber, styrene-butadiene rubber, or the like. The conductive rubber 2*b* has a length of 230 mm. A known magnetic one-component developer is used for a developing device 4.

A roller comprising rubber having a medium-range volume resistivity of about $10^{6}$–$10^{13}$ Ωcm is used as the transfer roller 5, which has a length of 230 mm as the charging roller 2.

The cleaning blade 7*a* of a cleaning device 7 comprises a chiplike rubber member $7a_2$ fixed on a distal end of a supporting plate. For example, urethane, silicone rubber, or the like may be used as the material for the rubber member $7a_2$, and the rubber member $7a_2$ has a length of 240 mm in the longitudinal direction.

The lubricant 7*d* is coated on an edge portion of the cleaning blade 7*a*. For example, a fluororesin, such as tetrafluoroethylene, vinylidene fluoride, or the like, pulverized powder of titanium oxide, strontium titanate, graphite fluoride, zinc stearate, or the like having an average particle size of about 0.5–10 $\mu$m is used as the lubricant 7*d*. Fine particles having an average particle size of about 0.5–10 $\mu$m made by polymerizing a silicone resin, an acrylic resin, an ethylene acrylic resin, or the like may also be used as the lubricant 7*d*.

A dispersion liquid obtained, for example, by dispersing powder in a volatile organic solvent is coated on the cleaning blade 7*a* to provide the lubricant 7*d*. For example, alcohol, such as methanol, ethanol, isopropanol, or the like, ketone, such as acetone, methyl ethyl ketone, cyclohexane, or the like, amide, such as N,N-dimethylformaldehyde, N,N-dimethylacetamide, or the like, sulfoxide, such as dimethyl sulfoxide or the like, ether, such as tetrahydrofuran, dioxane, ethylene glycol monomethyl ether, or the like, ester, such as methyl acetate, ethyl acetate, or the like, aliphatic halogenized hydrocarbon, such as chloroform, methylene chloride, dichloroethylene, carbon tetrachloride, trichloroethylene, or the like, or aromatic hydrocarbon, such as benzene, toluene, xylene, ligroin, monochlorobenzene, dichlorobenzene, or the like, may be used as the organic solvent.

In the above-described configuration, image forming durability tests were performed under the following conditions:

Process speed: 50 mm/sec

Latent-image potential:

Dark-portion potential=−650 V

Light-portion potential=−150 V

Primary bias voltage: A DC voltage of −670 V is superposed on an AC voltage of 500 Hz and 1,800 $V_{pp}$.

Developing conditions: A DC voltage of −500 V is superposed on an AC voltage of 1,800 Hz and 1,600 $V_{pp}$.

Transfer conditions: A transfer voltage subjected to constant-current control of +4 $\mu$A is applied.

No bending of the cleaning blade 7*a* occurred in environments of a low temperature and a low humidity, and a high temperature and a high humidity, and in an ordinary environment.

Although in the first embodiment, the length of the charging region and the length of the transfer region in the longitudinal direction are arranged to be substantially the same, the length of the transfer region in the longitudinal direction may be arranged to be longer than the length of the charging region in the longitudinal direction. According to this configuration, even if a deviation is present in the mounted position of the charging roller 2 or the transfer roller 5, a transfer bias voltage can be applied to the entire charging region, so that the surface potential of the photosensitive drum 1 at the contact portion of the cleaning blade 7*a* can be substantially 0 V uniformly. Accordingly, the assuredness of preventing bending of the cleaning blade 7*a* can be improved.

Second Embodiment

Figure 3:
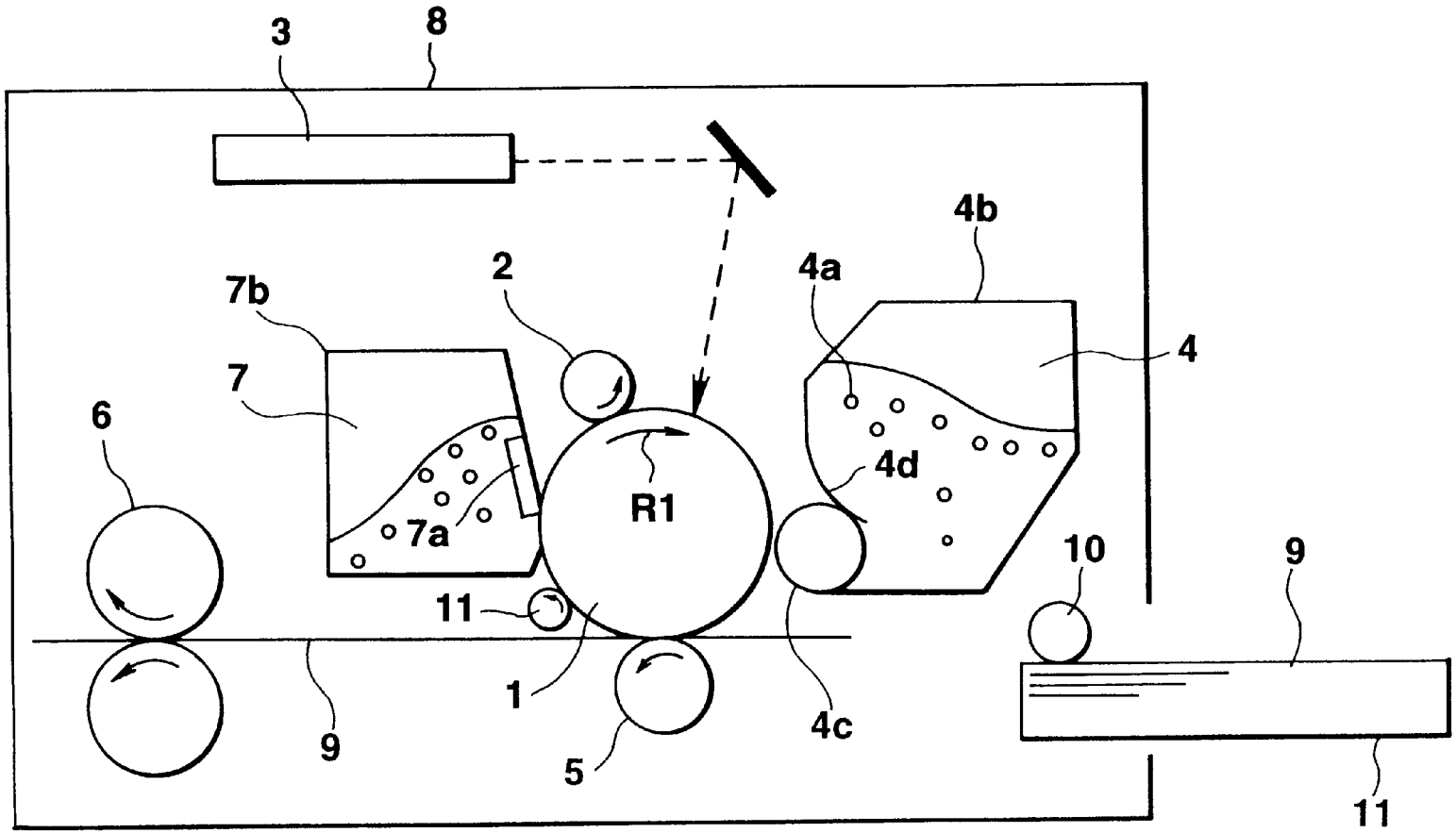
FIG. 3 is a schematic diagram illustrating the configuration of an image forming apparatus according to a second embodiment of the present invention.
Figure 4:
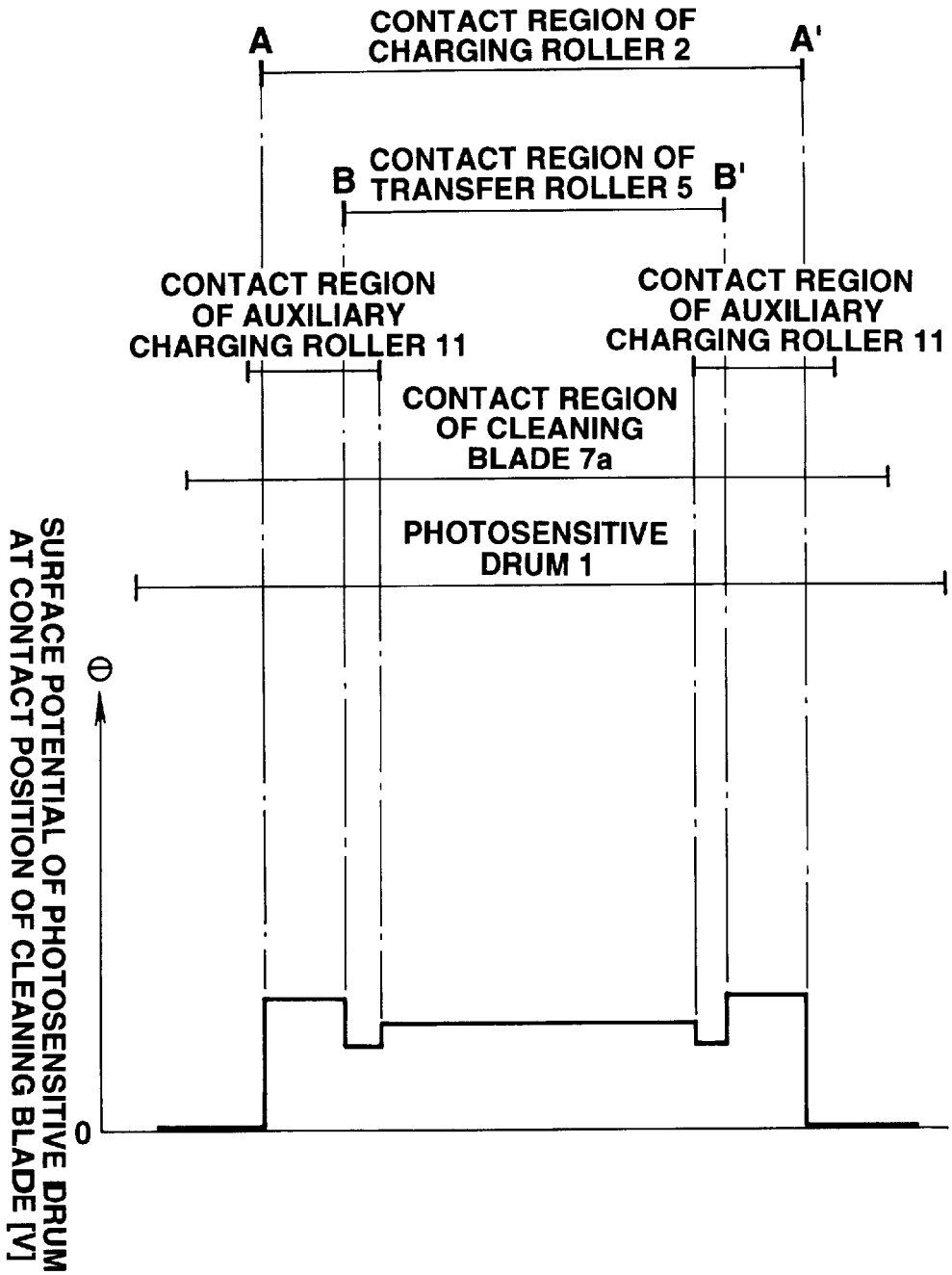
FIG. 4 is a diagram illustrating the surface potential of a photosensitive drum at contact regions of a charging roller, a transfer roller, and a cleaning blade in the second embodiment.

Next, a description will be provided of a second embodiment of the present invention with reference to FIGS. 3 and 4.

FIG. 3 is a schematic digram illustrating the configuration of an image forming apparatus according to the second embodiment. FIG. 4 is a diagram illustrating the surface potential of a photosensitive drum at contact regions of a charging roller, a transfer roller and a cleaning blade. In FIG. 3, the same components as those shown in FIG. 6 are indicated by the same reference characters, and a further description thereof will be omitted.

The second embodiment has a feature in that an auxiliary charging roller 11, serving as an auxiliary charging member, for applying a bias voltage having the same polarity as that applied to a transfer roller 5 is brought in contact at a position downstream from the transfer roller 5 and upstream from a cleaning device 7 in the direction of rotation of a photosensitive drum 1 and outside the contact region of the transfer roller 5 in the longitudinal direction. For example, a rubber roller whose resistivity is adjusted to a medium-range value is used as the auxiliary charging roller 11. The auxiliary charging roller 11 and a power supply (not shown) for applying a bias voltage thereto constitute potential unifying means.

A region between A and B and a region between B' and A' in the longitudinal direction of the photosensitive drum 1 are charged to negative polarity by the charging roller 2, but are not charged to positive polarity by the transfer roller 5. Hence, the surface potential of the photosensitive drum 1 at a portion downstream from the transfer roller 5 remains at a negative potential, but the surface regions of the photosensitive drum 1 between A an B and between B' and A' are charged to positive polarity by the auxiliary charging roller 11. By thus charging the surface regions to positive polarity, charges in the surface regions of the photosensitive drum 1 between A and B and between B' and A' at the contact position of the cleaning blade 7*a* are eliminated, so that the distribution of the surface potential of the photosensitive drum 1 is made to be substantially 0 V in the longitudinal direction. Accordingly, as in the first embodiment, it is possible to prevent stripping off of the lubricant 7*d* from the cleaning blade 7*a*, and therefore to prevent bending of the cleaning blade 7*a*.

Third Embodiment

Next, a third embodiment of the present invention will be described with reference to FIG. 5.

Figure 5:
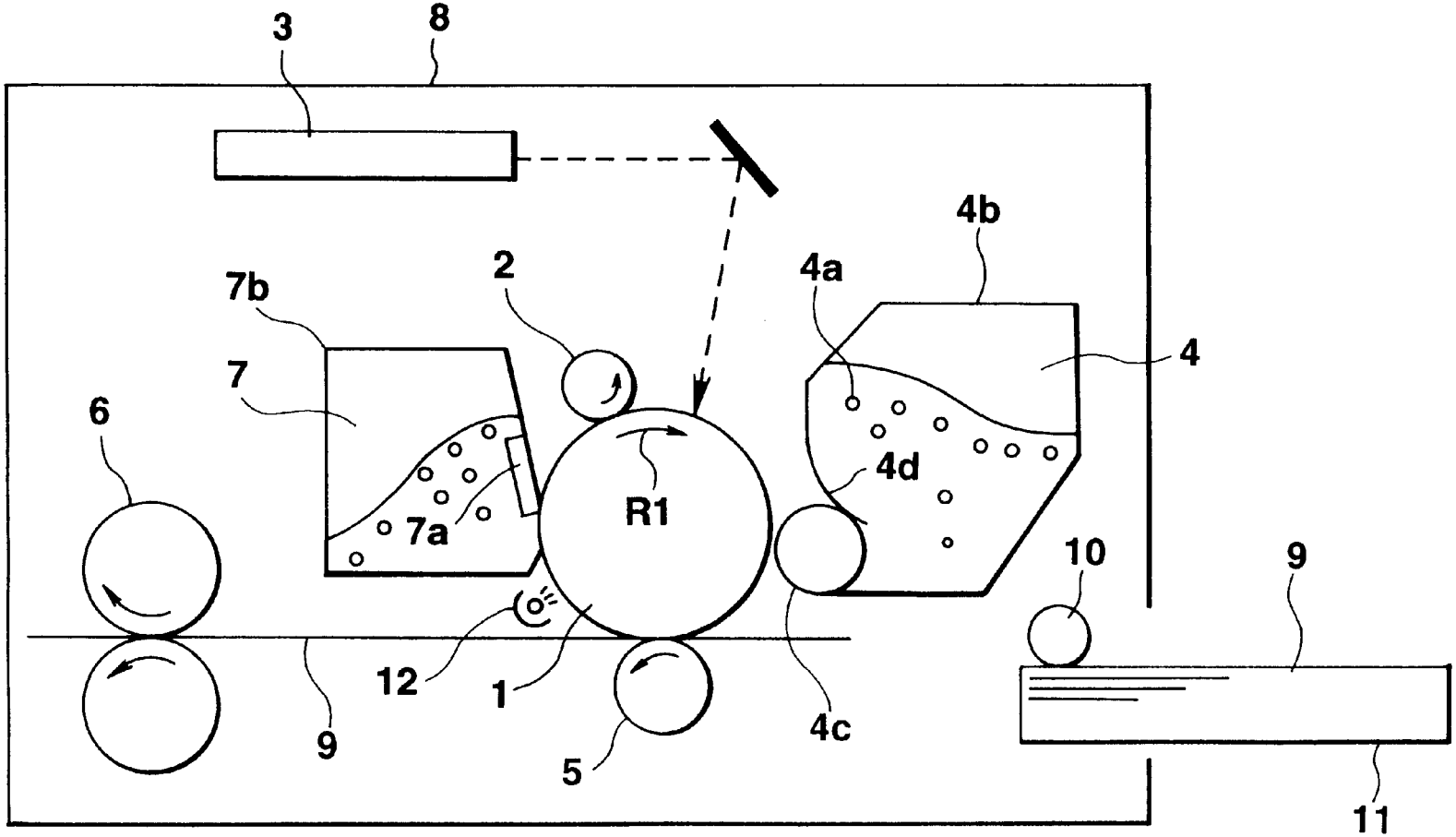
FIG. 5 is a schematic diagram illustrating the configuration of an image forming apparatus according to a third embodiment of the present invention.

FIG. 5 is a schematic diagram illustrating the configuration of an image forming apparatus according to a third embodiment of the present invention. In FIG. 5, the same components as those shown in FIG. 6 are indicated by the same reference characters, and a further description thereof will be omitted.

The third embodiment includes a feature in that, instead of the auxiliary charging roller 11 of the second embodiment, a charge removing lamp 12, serving as potential unifying means for removing charges on a surface region of a photosensitive drum 1 corresponding to the difference between the length of a charging roller 2 and the length of a transfer roller 5 in the longitudinal direction, is provided so as to face the photosensitive drum 1 at the position where the auxiliary charging roller 11 is provided. The surface potential of the region of the photosensitive drum 1 in the longitudinal direction that is charged by the charging roller 2 but is not charged by the transfer roller 5 in the image forming process is reduced by lighting the charge removing lamp 12, so that the potential of the region of the photosensitive drum 1 in the longitudinal direction where a cleaning blade 7*a* contacts can be substantially 0 V uniformly. Accordingly, it is possible to prevent stripping off of a lubricant 7*d* on the cleaning blade 7*a*, and therefore to prevent bending of the cleaning blade 7*a*.

In the foregoing embodiments, an electrophotographic photosensitive member is illustrated as an image bearing member. In the first and second embodiments, however, an intermediate transfer member where a toner image formed on a photosensitive member is transferred may also be used instead of the above-described electrophotographic photosensitive member.

The photosensitive member or the intermidate transfer member in these embodiments does not necessarily have the shape of a drum, but may also have the shape of a belt. Charging means or auxiliary charging means for the image bearing member is not necessarily a corona discharge unit, but may also be a roller, or a blade-shaped electrode.

An LED (light-emitting diode) array or a miniature bulb may be used as the light source for removing charges on the photosensitive member.

As described above, according to the first embodiment, since the length of the transfer means in the longitudinal direction is made to be longer than the length of the charging means in the longitudinal direction so that the surface potential of the image bearing member at the contact position of the cleaning blade is substantially uniform in the longitudinal direction, it is possible to prevent stripping off of the lubricant coated on the cleaning blade, and therefore to prevent bending of the cleaning blade 7*a*.

According to the second embodiment, an auxiliary charging member, constituting potential unifying means, for charging the surface region of the image bearing member corresponding to the difference between the length of the charging means and the length of the transfer means in the longitudinal direction is provided at a portion downstream from the transfer means and upstream from the cleaning blade in the moving direction of the image bearing member, and a bias voltage having the same potential as that of a bias voltage applied to the transfer means is applied to the auxiliary charging member. Hence, stripping off of the lubricant coated on the cleaning blade for the image bearing member can be prevented.

According to the third embodiment, a light source for removing charges, serving as potential unifying means, is provided at a portion downstream from the transfer means and upstream from the cleaning blade in the moving direction of the electrophotographic photosensitive member, serving as the image bearing member, and charges on the surface region of the photosensitive member corresponding to the difference between the length of the charging means and the length of the transfer means in the longitudinal direction are removed by the light source. Hence, stripping off of the lubricant coated on the cleaning blade can be prevented.

The individual components shown in outline in the drawings are all well-known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member;

charging means for charging said image bearing member;

developing means for forming a toner image by developing an electrostatic latent image formed on said image bearing member using a toner having a same polarity as a polarity of said charging means;

transfer means, having a width different from a width of said charging means, for applying a bias voltage having a polarity opposite to the polarity of said charging means to a transfer material in order to electrostatically transfer the toner image formed on said image bearing member onto the transfer material;

a cleaning blade member contacting said image bearing member in a counter direction relative to a moving direction of said image bearing member in order to scrape and remove toner particles remaining on said image bearing member after the image transfer;

means for reducing a charging potential difference between said charging means and said transfer means generated on said image bearing member, said means for reducing a charging potential difference including auxiliary charging means to which a bias voltage having a same polarity as a polarity of said transfer means is applied; and a lubricant provided between said image bearing member and said cleaning blade member.

2. An image forming apparatus according to claim 1, wherein said image bearing member comprises an electrophotographic photosensitive member, and wherein said means for reducing the charging potential difference comprises exposure means.

3. An image forming apparatus comprising:

an image bearing member;

charging means for charging said image bearing member while contacting said image bearing member;

developing means for forming a toner image by developing an electrostatic latent image formed on said image bearing member using a toner having a same polarity as a polarity of said charging means;

transfer means, having a width different from a width of said charging means and contacting a transfer material, for applying a bias voltage having a polarity opposite to the polarity of said charging means to a transfer material in order to electrostatically transfer the toner image formed on said image bearing member onto the transfer material;

a cleaning blade member contacting said image bearing member in a counter direction relative to a moving direction of said image bearing member in order to scrape and remove toner particles remaining on said image bearing member after the image transfer;

means for reducing a charging potential difference between aid charging means and said transfer means generated on said image bearing member, said means for reducing a charging potential difference including auxiliary charging means to which a bias voltage having a same polarity as a polarity of said transfer means is applied; and a lubricant provided between said image bearing member and said cleaning blade member.

4. An image forming apparatus according to claim 3, wherein said image bearing member comprises an electrophotographic photosensitive member, and wherein said means for reducing the charging potential difference comprises exposure means.

5. An image forming apparatus comprising:

a photosensitive member;

a charger for charging said photosensitive member while contacting said photosensitive member;

a developing unit for forming a toner image by developing an electrostatic lantern image formed on said photosensitive member using a toner having a same polarity as a polarity of said charger;

a transfer electrode, having a width different from a width of said charger and contacting a transfer material, for applying a bias voltage having polarity opposite to the polarity of said charger to the transfer material in order to electrostatically transfer the toner image formed on said photosensitive member onto the transfer material;

a cleaning blade member contacting said image bearing member in a counter direction relative to a moving direction of said image bearing member in order to scrape and remove toner particles remaining on said image bearing member after the image transfer;

means for reducing a charging potential difference between said charger and said transfer electrode generated on said photosensitive member, said means for reducing a charging potential difference including auxiliary charging means to which a bias voltage having a same polarity as a polarity of said transfer means is applied; and a lubricant provided between said image bearing member and said cleaning blade member.

6. An image forming apparatus according to claim 5, wherein said means for reducing the charging potential difference comprises an exposure light source.

7. An image forming apparatus comprising:

an image bearing member for bearing a toner image;

a first charging means for charging said image bearing member;

a transfer charging means for charging a transfer member in order to transfer said image toner image to a transfer material, wherein said transfer charging means is set downstream of said first charging means in the moving direction of said image bearing member and has an opposite charging polarity to a charging polarity of said first charging means;

a cleaning blade member having a lubricant thereon for cleaning said image bearing member, wherein said lubricant is provided between said blade member and said image bearing member;

a second charging means for reducing a charging potential of a portion of said image bearing member which is charged by said first charging means and is not charged by said transfer charging means in a longitudinal direction of said image bearing member, wherein the second charging means, which is disposed between said transfer charging means and said cleaning blade member in the moving direction of said image bearing member, is a charging means of a same charging polarity as a charging polarity of said transfer charging means.

8. An image forming apparatus according to claim 7, wherein said first charging means contacts said image bearing member.

9. An image forming apparatus according to claim 7, wherein said transfer charging means contacts said image bearing member.

10. An image forming apparatus according to claim 7, wherein said second charging means contacts the portion of said image bearing member which is charged by said first charging means and is not charged by said transfer charging means.

11. An image forming apparatus according to claim 7, wherein the charged portion by said first charging means includes the charged portion by said transfer charging means in the longitudinal direction of said image bearing member.

12. An image forming apparatus according to claim 7, wherein said blade member is a rubber member.

13. An image forming apparatus according to claim 7, wherein said image bearing member is a photosensitive member.

14. An image forming apparatus comprising:

an image bearing member for bearing toner image;

a transfer charging means for charging a transfer material in order to transfer toner image to the transfer material;

a charging means for charging said image bearing member upstream of said transfer charging means in the moving direction of said image bearing member, wherein said charging means has an opposite charging polarity to a charging polarity of said transfer charging means; and a blade member having a lubricant thereon for cleaning said image bearing member downstream of said transfer charging means in the moving direction of said image bearing member, wherein said lubricant is provided between said image bearing member and said blade member;

wherein a portion of said image bearing member, which is cleaned by said blade member with said lubricant, is charged by said charging means and said transfer charging means, and the length of the portion charged by said transfer charging means and the length of the portion charged by said charging means are substantially the same in the longitudinal direction of said image bearing member.

15. An image forming apparatus according to claim 14, wherein said blade member extends in the longitudinal direction of said image bearing member.

16. An image forming apparatus according to claim 14, wherein said transfer charging means contacts said image bearing member.

17. An image forming apparatus according to claim 14, wherein said charging means contacts said image bearing member.

* * * * *

UNITED STATES PATENT AND TRADEMARK OFFICE

CERTIFICATE OF CORRECTION

PATENT NO. : 5,995,785

DATED : November 30, 1999

INVENTOR(S) : JUNICHI KATO, ET AL.

It is certified that error appears in the above-identified patent and that said Letters Patent is hereby corrected as shown below:

Column 10,
Line 51, "lantern" should read --latent--.

Signed and Sealed this

Seventh Day of November, 2000

*Attest:*

Q. TODD DICKINSON

*Attesting Officer*

*Director of Patents and Trademarks*